United States Patent [19]

Johnson

[11] Patent Number: 4,823,998

[45] Date of Patent: Apr. 25, 1989

[54] SLING FOR CARRYING SHOULDER WEAPON IN A HORIZONTAL ORIENTATION

[76] Inventor: David A. Johnson, 3432 Tanglewood Way, Salem, Oreg. 97302

[21] Appl. No.: 856,642

[22] Filed: Apr. 25, 1986

[51] Int. Cl.[4] ..... F41C 23/02

[52] U.S. Cl. ..... 224/150; 224/913

[58] Field of Search ..... 224/150, 913, 202, 205; 24/2.5, 115 R, 115 A, 115 G, 115 H, 115 M, 265 AL, 265 EC

[56] References Cited

U.S. PATENT DOCUMENTS

| | | | |
|---|---|---|---|
| 1,010,301 | 11/1911 | Neats | 24/115 G |
| 1,146,934 | 7/1915 | Gleeson | 24/115 H |
| 1,383,125 | 6/1921 | Kennedy, Jr. | 224/150 |
| 2,059,949 | 11/1936 | Imler | 224/913 X |
| 2,296,733 | 9/1942 | Paolino | 224/913 X |
| 2,812,123 | 11/1957 | Girton | 224/913 X |
| 2,830,747 | 4/1958 | Creste | 224/150 |
| 2,869,906 | 1/1959 | Person | 24/115 A X |
| 2,915,233 | 12/1959 | Moomaw | 224/913 X |
| 3,211,351 | 10/1965 | Somple | 224/150 |
| 3,334,794 | 8/1967 | Saari et al. | 224/150 |
| 3,495,770 | 2/1970 | Seltmann, Jr. et al. | 224/150 |
| 3,721,750 | 3/1973 | Countryman | 24/265 R X |
| 3,952,376 | 4/1976 | Ellis | 24/265 AL X |
| 3,957,237 | 5/1976 | Campbell | 24/115 M X |
| 3,965,544 | 6/1976 | Boden | 24/115 M X |
| 4,098,441 | 7/1978 | Campbell | 224/150 |
| 4,124,922 | 11/1978 | Speedie | 24/115 R |
| 4,249,686 | 2/1981 | Morwood | 224/913 X |
| 4,299,343 | 11/1981 | Atchisson | 224/150 X |
| 4,384,389 | 5/1983 | Sato | 24/115 M X |
| 4,393,549 | 7/1983 | Leonardo | 24/115 A |
| 4,449,275 | 5/1984 | Nava | 24/265 EC X |
| 4,555,051 | 11/1985 | Johnson | 224/150 |
| 4,562,945 | 1/1986 | Erlandson | 224/150 X |
| 4,571,872 | 2/1986 | Johnson | 224/150 X |
| 4,613,067 | 9/1986 | Gann | 224/150 |
| 4,691,852 | 9/1987 | Phelps | 224/150 |

FOREIGN PATENT DOCUMENTS

| | | | |
|---|---|---|---|
| 631642 | 11/1961 | Canada | 24/115 R |

OTHER PUBLICATIONS

Adapter Kit, Top Sling-DAAFO1 70 C 1005-May 25, 1970.

*Primary Examiner*—Renee S. Luebke

*Attorney, Agent, or Firm*—Chernoff, Vilhauer, McClung & Stenzel

[57] ABSTRACT

A sling assembly for use in carrying shoulder weapons, such as hunting rifles, in a horizontal ready position. A sling strap is connected to sling swivels mounted on the weapon in the conventional positions at the bottom of the butt stock and forestock, by loops which encircle the butt stock and the front portion of the weapon. The rear part of the sling strap is fixed to the rear loop, which is long enough to surround the butt stock and to slip rearwardly off the butt stock as the weapon is raised to the shooter's shoulder. The front end of the strap is free to hang down beside the front portion of the weapon with only the front loop around the top of the weapon, where it does not interfere with use of the sights. Various ways are disclosed to attach the loops to sling swivels or to a handguard on the front portion of the weapon. In one embodiment a slide fastener holds the sling strap at a desired length but is adjustable using only one hand.

15 Claims, 8 Drawing Sheets

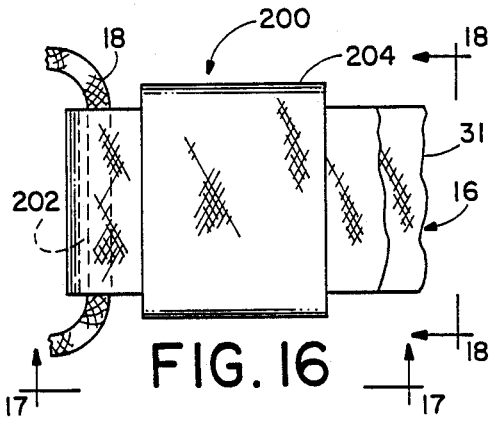
FIG. 16
FIG. 19
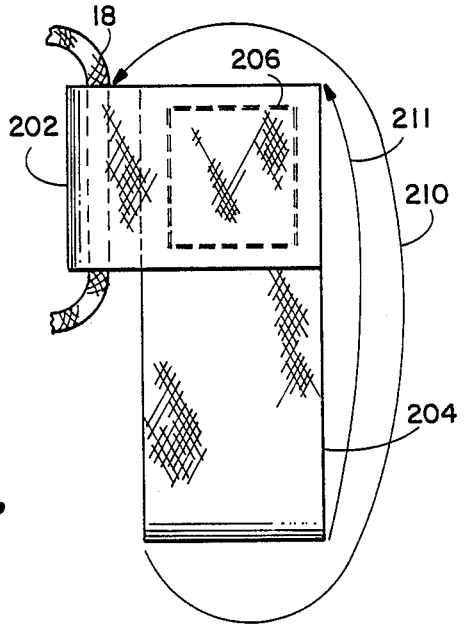
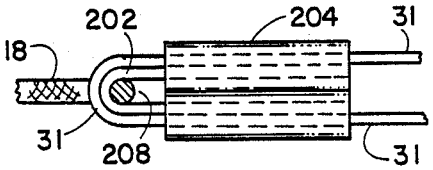
FIG. 17
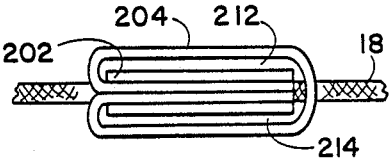
FIG. 18
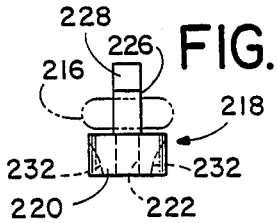
FIG. 23
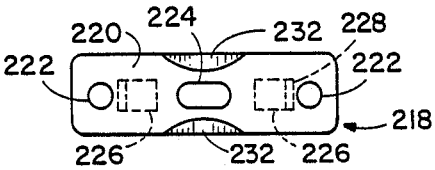
FIG. 22
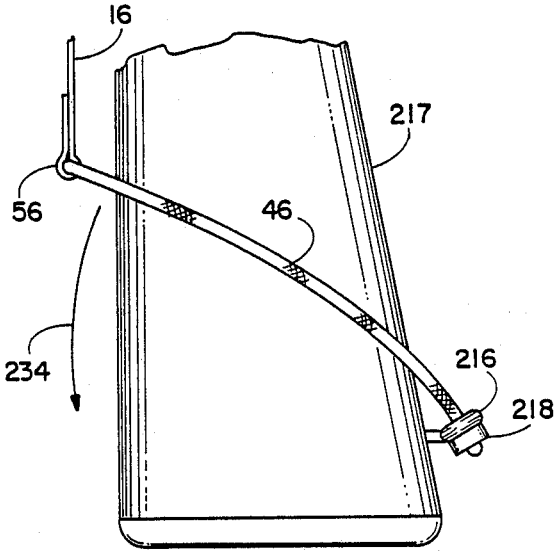
FIG. 20
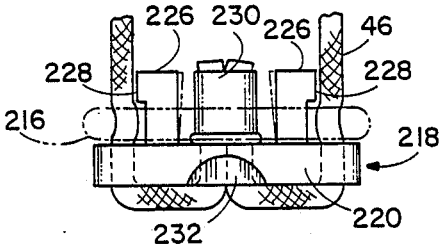
FIG. 21

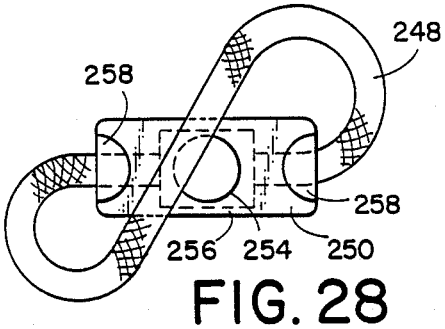
FIG. 28
FIG. 29
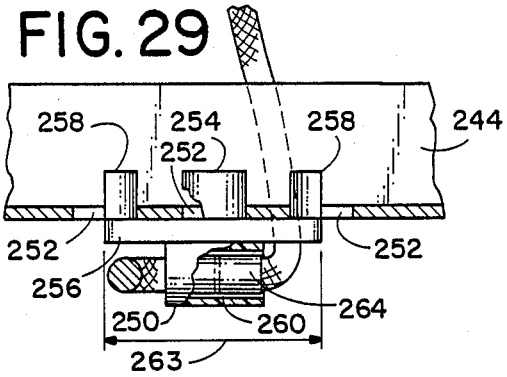
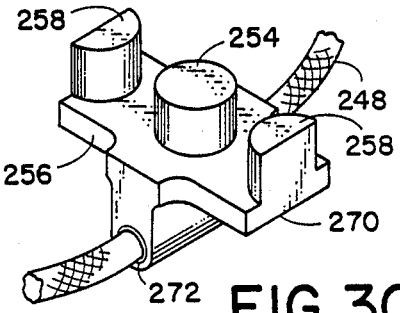
FIG. 30
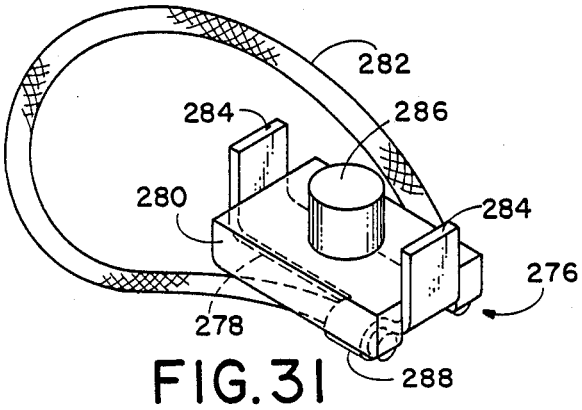
FIG. 31
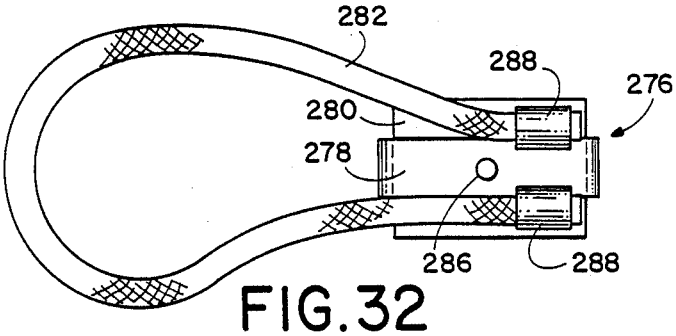
FIG. 32
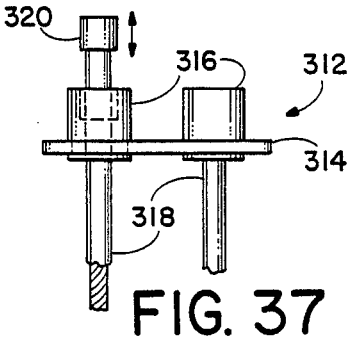
FIG. 37
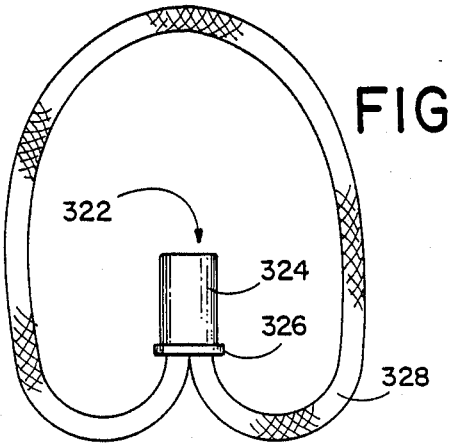
FIG. 39
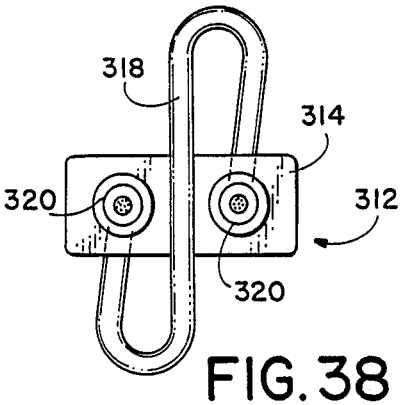
FIG. 38

SLING FOR CARRYING SHOULDER WEAPON IN A HORIZONTAL ORIENTATION

BACKGROUND OF THE INVENTION

The present invention relates to slings for firearms and the like, and particularly to a sling for carrying a weapon in a generally horizontal position of readiness.

In order to be able to use shoulder weapons such as hunting rifles and the like as quickly as possible, yet have freedom to use their hands, many hunters would prefer to carry such weapons in a forwardly or laterally directed position with the weapon upright and its barrel or main longitudinal axis approximately horizontal. This position is known as a horizontal ready position.

Rifles, particularly military rifles, have long been equipped with slings permitting them to be carried without encumbering the carrier's hands. Such slings are also useful in bracing such weapons during use, to achieve a better aim. Slings have conventionally been located attached to the bottom of a rifle or other shoulder-fired weapon, at least partly because location of a sling mounting at the top of the weapon might interfere with the use of sights mounted low on the top of the weapon. Conventional military type slings, however, do not permit a weapon to be carried suspended by the sling in the preferred horizontal ready position.

Moving the point of attachment of a sling to the top of a weapon so that it might be carried in a horizontal ready position has previously resulted in the sling interfering with the ability to raise the weapon quickly to the proper position against the user's shoulder. For example, when a sling is attached at the top of the rear end of the butt stock, raising the weapon to a horizontal position with the butt end of the stock against the user's shoulder might result in the sling being caught between the stock and the user's shoulder or lying across the top of the cheek rest area of the stock, where it would adversely affect the user's ability to aim the weapon quickly and accurately. Since the ability to carry a weapon in the horizontal ready position can provide a definite advantage in the ability to shoot quickly, either in infantry warfare or in hunting, it is desirable to provide a sling which can be used to carry a rifle in the horizontal ready position, but which does not interfere with the use of the weapon's sights.

A previously attempted answer to these needs was an adaptor kit for attaching the front of the sling strap to the front sight assembly of a military rifle, with the rear end of the sling fastened as a noose extending through the conventional sling swivel and around the butt stock. This, however, left the rear of the sling in an undesirable location during use of the weapon, and the front attachment was likely to be noisy.

Particularly with hunting rifles, it is not uncommon to have stocks made of expensive wood, beautifully finished. Owners of such rifles are, naturally enough, reluctant to attach a sling which might damage the finish of the stock. It is therefore desirable to provide a sling which can be used to carry a hunting rifle in the horizontal ready position without marring the finish of its stock.

For both hunting and military weapons it is desirable to avoid any noisy attachments.

Brokus U.S. Pat. No. 3,606,109 discloses a gun sling including a socket loosely fitted to the underside of the rear of the stock, to facilitate carrying a gun in a horizontal ready position. The socket taught by Brokus, however, is undesirably bulky and apparently does not remain in place unless tension is maintained in the sling.

Moomaw U.S. Pat. No. 2,915,233 teaches a gun sling including a stock-supporting loop or socket which enables a gun to be carried in a horizontal ready position. Raising the gun from a horizontal ready position to a normal firing position with its stock against the user's shoulder, however, completely disconnects the rear end of the sling from the stock, requiring it to be replaced on the stock before the sling can be used subsequently to carry the gun in any position whatsoever.

Johnson U.S. Pat. No. 4,555,051 discloses a sling assembly of the desired type which is particularly adapted to certain military weapons equipped with front sight assemblies that are large enough to be used as a point of attachment for a front end of the sling strap. The sling assembly disclosed, however, is not particularly well adapted to weapons not equipped with such a high front sight assembly.

What is needed, therefore, is a sling assembly which can be used to carry a weapon such as a hunting rifle quietly, in a position of readiness in which the weapon is upright with its longitudinal main axis directed generally horizontally, in which the sling assembly does not interfere with the ability to raise the butt end of the weapon's stock properly to the user's shoulder, nor with the ability to use the installed sights of the weapon, and in which the sling assembly is not likely to mar the finish of the weapon or its stock.

SUMMARY OF THE INVENTION

The present invention overcomes the shortcomings of the previously known slings for rifles and the like and provides a sling assembly which can be used to carry such a weapon, supporting the weapon in a substantially upright and horizontally extending position, leaving the carrier's hands free for other tasks, and which permits such a weapon to be raised to its normal shooting position without the sling strap interfering with placement of the butt stock against the user's shoulder, nor with the shooter's view of the weapon's sights.

According to the present invention, a sling assembly includes a sling strap member to pass over a user's shoulder, supporting a shoulder weapon. A rear end of the sling strap is fastened to a loop or similar arrangement of two parts which pass downward along opposite sides of the butt stock, to a sling swivel located conventionally on the bottom of the stock. A front end of the sling strap is attached to a front loop which encircles the barrel and which is fastened to the front of the weapon either by a sling swivel located conventionally on the bottom of the front portion of the weapon, or by another secure device. The loops are attached to the sling swivels in desired ones of several ways to provide secure, fixed, attachment which prevents bare metal from contacting the stock of the weapon.

The loop or pair of parallel parts connecting the rear end of the sling strap to the sling swivel is fastened fixedly to the sling strap to maintain the upright orientation of the weapon. The front end of the sling strap may be free to move about the front loop so that the front end of the sling strap can fall down alongside the front portion of the weapon, out of the way of its sights, when the weapon is being aimed.

An embodiment of the invention intended particularly for use with military weapons includes a stopper which is intended for attachment of the rear elongate connecting member to the fixedly installed sling receiving loop on the lower rear portion of the butt stock portion of certain military rifles.

Several embodiments of the invention include a front loop which is attached to a handguard which surrounds the barrel of the weapon behind the conventional military front sling swivel.

In a preferred embodiment of the invention both the front loop and rear elongate connecting member are of round cord with the ends of each cord held side by side by a crimped tubular metal fastener. The fastener and cord are held in a folded length of strap material of, for example, leather, held together in a folded configuration by a thong laced through the leather to connect it to the sling swivel and the loop of cord.

In a preferred embodiment of the invention a slide fastener is used to make the overall effective length of the sling assembly easily adjustable by merely grasping and moving the slide fastener with one hand.

In an alternative embodiment of the invention the front loop and the elongate connecting member may be of flat or tubular woven webbing, which may be sewn to a length of webbing which holds a sling swivel.

It is therefore a principal objective of the present invention to provide an improved sling assembly for a shoulder weapon such as a hunting rifle, for holding such a weapon in an upright horizontal ready position, while keeping the user's hands free for other purposes.

It is another important objective of the present invention to provide a sling assembly which is useful to aid in aiming the weapon, and which also is usable to carry the weapon in a horizontal ready position.

It is yet a further objective of the present invention to provide a sling assembly which is usable to carry a rifle in a horizontal ready position, but which will not obstruct normal use of the weapon's installed iron sights.

A principal feature of the sling assembly of the invention is the provision of a loop of flexible material fixedly attached to a rear end of the sling strap and having opposite parts which extend upward alongside the opposite sides of the butt stock of a weapon and which are long enough to be slipped rearwardly off the top of the stock while remaining attached to a sling swivel fastened to the conventional position on the bottom of the stock.

Another important feature of one embodiment of the invention is a loop of cord whose two ends are held together by a fastener which is sewn into a loop of webbing material fastened to the loop of a sling swivel.

A feature of another embodiment of the invention is an adjustable fastener which makes it convenient for the sling assembly to be used to carry the weapon in the conventional manner with its barrel directed upwards.

It is an important advantage of the sling provided by the present invention that it is lighter, quieter, and less cumbersome than most previously known devices intended to facilitate carrying a rifle in a horizontal ready position.

The foregoing and other objectives, features and advantages of the present invention will be more readily understood upon consideration of the following detailed description of the invention taken in conjunction with the accompanying drawings.

BRIEF DESCRIPTION OF THE DRAWINGS

FIG. 16 is a front view of another form of attachment device for the front loop of the sling of the invention.

FIG. 17 is a side view of the attachment device shown in FIG. 16.

FIG. 18 is an end view of the attachment device shown in FIG. 16.

FIG. 19 is a front view of the attachment device shown in FIG. 16, partially assembled, showing particularly its construction.

FIG. 20 is a side view of a portion of the butt stock of a military rifle, together with a rear end attachment assembly for a sling according to the invention, including a stopper device for attaching the sling to the sling receiving loop of the rifle.

FIG. 21 is a front elevational view of the stopper shown in FIG. 20, together with portions of the cord used to attach it to the sling strap member.

FIG. 22 is a bottom view of the stopper shown in FIG. 21.

FIG. 23 is an end elevational view of the stopper shown in FIG. 21.

FIG. 28 is a top view of the front loop attachment device shown in FIGS. 24–27, at an enlarged scale.

FIG. 29 is a sectional detail view of the lower portion of the handguard of the weapon shown in FIG. 24, with the front loop attachment device shown in FIG. 24 engaged therein.

FIG. 30 is a perspective view of a different front loop attachment device according to the invention.

FIG. 31 is a perspective view of a third front loop attachment device for attaching the front end of a sling strap to the handguard of a military weapon such as that shown in FIG. 24.

FIG. 32 is a bottom view of the device shown in FIG. 31.

FIG. 37 is a side view of a seventh front loop attachment device for use in attaching a front strap loop to the handguard of a military rifle such as that shown in FIG. 24.

FIG. 38 is a top plan view of the device shown in FIG. 37.

FIG. 39 is a view of a simple eighth front loop attachment device for attaching a front strap loop to a handguard of a military weapon such as that shown in FIG. 24.

DETAILED DESCRIPTION OF THE INVENTION

Figures 1, 2, 3, 4, 5:
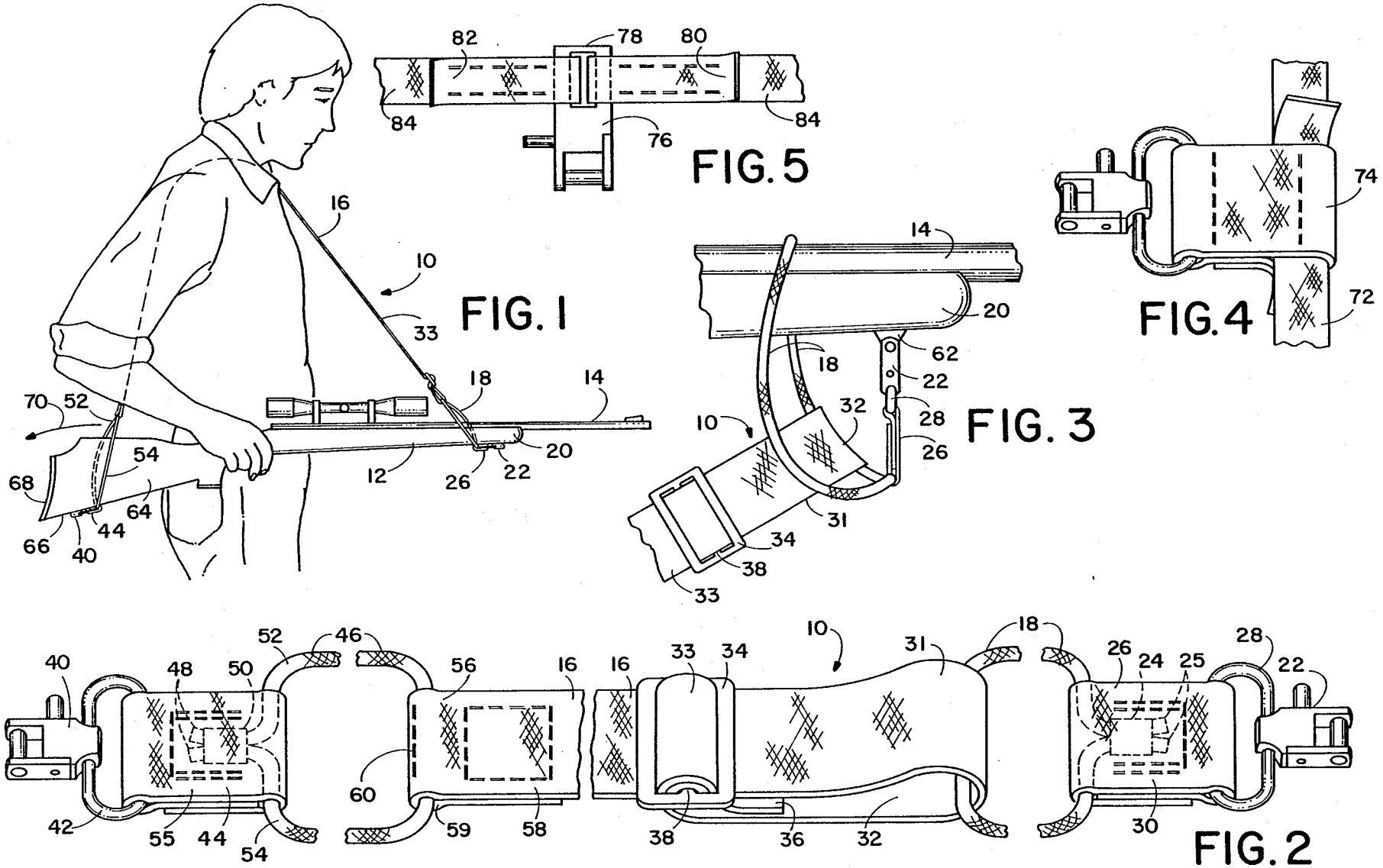
FIG. 1 is a view of a person carrying a rifle equipped with a sling assembly which embodies the present invention.
FIG. 2 is a perspective view of the sling assembly of FIG. 1.
FIG. 3 is a view of a front portion of the rifle shown in FIG. 1, together with the front end portion of the sling assembly.
FIG. 4 is a perspective view of a sling swivel, showing an alternative attachment of a front end loop of the sling, assembly of the present invention.
FIG. 5 is a view of a sling swivel and a portion of a loop of webbing material showing the manner of attachment of the webbing material to the sling swivel for use in the sling assembly of the present invention.

Referring now to the drawings, in FIG. 1, a sling assembly 10 is shown being used to carry a rifle 12 in a "horizontal ready" position, in which the barrel 14 is in a substantially horizontal position directed forwardly or somewhat toward the user's side. The rifle 12 is in an upright position, in which it is necessary for the shooter only to raise the rifle to his shoulder in the normal manner, without having to reorient it, in order to be ready to aim and shoot.

As is shown additionally in greater detail in FIGS. 2 and 3, the sling assembly 10 includes a strap member 16 of flexible material, for example, woven nylon webbing material about 25–32 mm wide, which is well known for use in rifle sling assemblies. A front loop 18, preferably of a round braided cord, encircles the barrel 14 and forestock 20 of the rifle 12, and is connected to a sling swivel 22. For example, the nylon cord known as parachute cord, having a braided cover and a diameter of about 4 mm, is suitable as the front loop 18. In the embodiment of the invention shown in FIGS. 1–3, the front loop 18 is constructed of a single piece of parachute cord having its ends 25 held side by side, extending in the same direction, by a fastener such as a tubular metal collar 24 crimped in place to hold the two ends of the front loop 18 securely together side by side.

The front loop 18 is connected with the sling swivel 22 by a short length 26 of webbing material similar to that of which the sling strap member 16 is constructed. The length of webbing 26 extends through a sling receiving loop 28 of the sling swivel 22, and is folded around a portion of the front loop 18 including the metal fastener 24. The opposite parts of the front loop 18 extend toward the fastener 24 transversely, from opposite sides of the length of webbing 26, and a U-shaped line of stitching 30 holds together the overlapped ends and middle portion of the length of webbing 26. The line of stitching 30 extends around the metal fastener 24 and the two ends 25 of the loop 18, preventing the loop 18 from slipping sideways through the folded length of webbing 26, and covers the fastener 24 so that it cannot mar the rifle 12.

The front loop 18 is preferably about 10 inches in circumference, although this measurement is not critical. What is important is that the loop is big enough to fit quite loosely about the barrel 14 and forestock 20, which are the front portion of the rifle 12.

A front end portion 32 of the sling strap member 16 is folded back upon itself, extending in chain link fashion through the front loop 18 as a strap member adjustable loop 31. The front end 32 is fastened adjustably to a portion 33 of the sling strap member 16 by a three-bar slide 34. A terminal portion 36 may be looped about the central bar 38 of the three-bar slide 34 and sewn in place against the front end portion 32 of the strap member 16, if desired, to attach the front end portion 32 more permanently through the front loop 18.

A suitable three-bar slide 34 is available from the Fastex Corporation of Des Plaines, Ill.

A rear sling swivel 40 is similar to the sling swivel 22 and includes a sling receiving loop 42. A length of webbing 44 similar to that of the sling strap member 16 is fastened to the sling receiving loop 42, attaching to it a rear elongate connecting member 46 in the form of a loop of material such as parachute cord, the loop having a circumference of, preferably, at least about 17 inches. The rear elongate connecting member 46 has its ends 48 joined together by a crimped tubular metal fastener 50 similar to the fastener 24, with the opposite parts 52 and 54 extending transversely in opposite directions from within the folded length of webbing material 44. The length of webbing material 44 is fastened with its two ends overlapping its middle portion, and the ends 48 and fastener 50 of the elongate connecting member 46 are secured against slipping sideways through the folded length of webbing material 44 by a U-shaped pattern of stitching 55 similar to the pattern 30 of stitching used with the length of webbing material 26. A rear end portion 56 of the sling strap member 16 is wrapped tightly about the central portion of the rear elongate connecting member 46 and secured to itself, as by stitching 58, forming a rear strap loop 59. Additionally, the rear end portion 56 is stitched to the elongate connecting member 46, as at 60, so that the two parts 52 and 54 on opposite sides are securely held so as to be of equal length, as indicated in FIG. 1.

The sling assembly 10 is attached to a shoulder weapon such as the rifle 12 by attaching the sling swivels 22 and 40 to respective sling mounting eyes such as the forward sling mounting eye 62 shown in FIG. 3. The front loop 18 is disposed upwardly about the front portion of the rifle 12, while the rear elongate connecting member 46 is attached to the butt stock 64 with one of the parts 52 and 54 extending upwardly alongside each side of the butt stock 64 from the bottom 66 thereof, where a sling mounting eye is attached in the conventional location. Because the midpoint of the rear elongate connecting member 46 is attached to the rear end portion 56, any tendency of the rifle 12 to tip to either side results in the particular part 52 or 54 on that side of the butt stock 64 being placed in tension and tending to upright the rifle 12, thus maintaining it in its horizontal ready position as shown in FIG. 1.

When it is desired to fire the rifle 12, it may be raised to the usual shooting position, bringing the butt end 68 against the shooter's shoulder in the normal fashion. The sling assembly 10 does not interfere with raising the rifle 12 to the normal shooting position, as the rear elongate connecting member 46 is long enough to clear the butt end 68 and i thus free to drop rearwardly, as shown by the arrow 70, as the rifle is raised and moved forward. The front end 32 of the sling strap member 16 is free to drop to the side of the front portion of the rifle, to the position shown in FIG. 3. Thus, the rear end portion 56 of the sling strap member 16 hangs down beneath the butt stock 64, and the front loop 18 lies atop the barrel 14, where it is low enough not to obstruct the shooter's view of the sights when the rifle 12 is held in the normal shooting position.

Because all of the exposed parts of the sling assembly 10, except for the three-bar slide 34, are of soft material, the sling assembly 10 of the invention does not mar the finish of the forestock 20 or butt stock 64 of the rifle 12, nor make undesirable noise by striking against the rifle 12.

While it is preferred to use a cord such as parachute cord as described in conjunction with the sling assembly 10 shown in FIGS. 1–3, either or both of the front loop 18 and rear elongate connecting member 46 may instead be of a flat webbing material 70, as shown in FIG. 4. The opposite ends of such webbing material 70 may be overlapped, sewn together, and sewn to a length of webbing 74 which is equivalent to the lengths of webbing 26 and 44, with the webbing material 70 extending transversely of the length of webbing 74, to fasten the sling assembly to a sling swivel. The webbing material 72 may be in the form of a ribbon-like flat webbing or a flat tubular webbing material, either of which is commercially available. The width of such webbing is preferably about ½ to ⅝ inch (12.7–15.9 mm).

Figure 6:
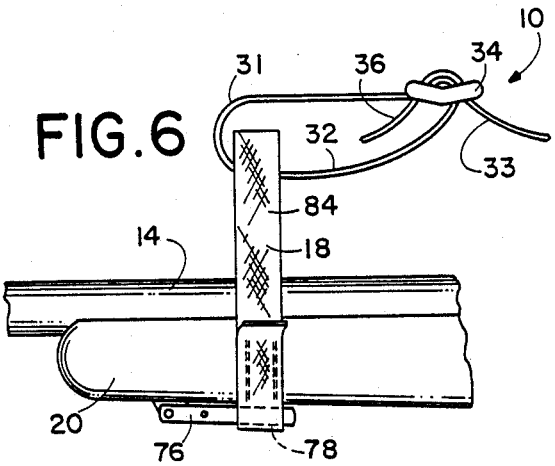
FIG. 6 is a view of the sling swivel and loop of webbing material shown in FIG. 5, showing their use in the front loop of the sling assembly of the present invention.

A sling swivel 76, shown in FIG. 5, may be used instead of the more conventional sling swivel shown in FIGS. 1–4 to attach the ends of a sling assembly 10 to a shoulder weapon such as the rifle 12. The sling swivel 76 includes a fixed ring 78 instead of the pivotable sling receiving loop 28 of the sling swivel 22. Each of the two ends 80 and 82 of a length of webbing 84 extends through the ring 78 and is folded back and stitched to the webbing forming a respective loop to secure the length of webbing 84 to the sling swivel 76, either as a front loop 18, or as a rear elongate connecting member 46 of the sling assembly 10. The sling swivel 76 and length of webbing 74 are shown in FIG. 6 in use as a front loop 18 of a sling assembly 10. This method of attachment provides an additional measure of protection against marring the finish of a rifle stock, as the webbing fastened to the sling swivel 76 in this fashion prevents the sling swivel 76 from coming into contact with the rifle stock.

Figure 7:
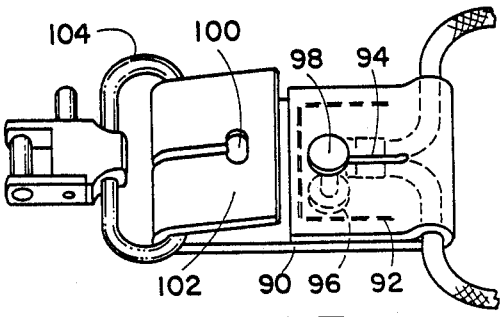
FIG. 7 shows a sling swivel and a portion of a cord loop forming part of a sling assembly according to the present invention, showing the manner of attachment of a leather strap for attaching the cord loop to the sling swivel.

Referring now to FIG. 7, another fixture for attachment of the front loop or rear elongate connecting member of the sling assembly 10 may include a short strap 90 of material such as leather. One end of the strap 90 is folded over and sewn with a U-shaped pattern of stitching 92 similar to that in the length of webbing material 26, to hold a loop of cord material in the fashion used to retain the front loop 18 and the rear elongate connecting member 46 in the lengths of webbing 26 and 44 of the sling assembly 10 shown in FIG. 2. A buttonhole 94 is defined in the strap material exposed within the U-shaped pattern of stitching, and a fastener such as a two-headed stud 96 is fastened in the buttonhole 94, exposing one head or button 98. Another buttonhole 100 is defined in an opposite end portion 102 of the leather strap material, permitting the leather strap material to be fastened extending removably through the sling receiving loop 104 of a sling swivel, by engaging the button 98 in the bottonhole 100.

Figure 8:
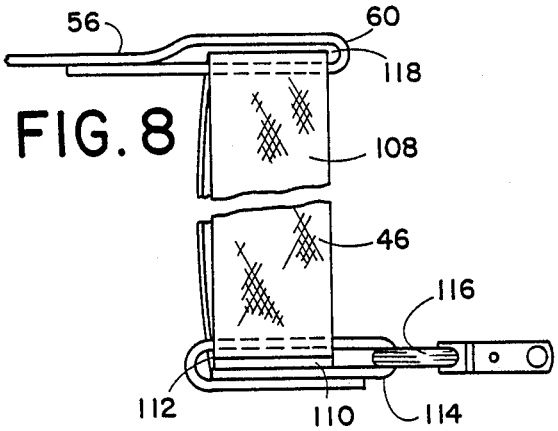
FIG. 8 is a view showing one manner of attaching a loop of wide webbing material to a sling swivel and to a sling strap member for use as the rear loop of a sling assembly according to the present invention.

As a further alternative manner of attaching the sling strap member 16 of a sling assembly 10 to a sling swivel, a central portion 118 of a length of webbing 108 similar to that used for the sling strap member 16 may be folded along a longitudinal line and stitched to the rear end loop 60 of the sling strap member 16, extending transversely, to serve as the rear elongate connecting member 46, as shown in FIG. 8. The opposite end portions 110 and 112 are located in overlapping registration with one another and are held extending transversely within a folded loop of similar webbing material 114 extending through the sling-receiving loop 116 of a sling swivel, the webbing 114 and 108 being fastened together by appropriate stitching.

Figure 9:
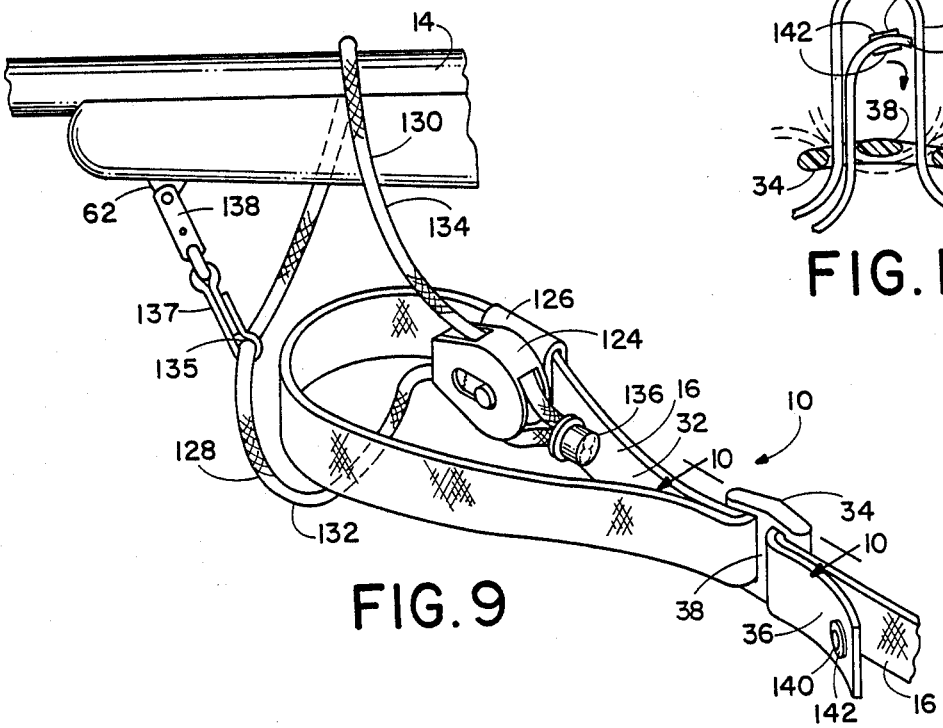
FIG. 9 shows a further alternative manner of connecting a cord loop to the front end of a sling strap for use as a part of a sling assembly according to the present invention.

Referring also to FIG. 9, yet a further form of attachment, particularly useful for the front end of the sling strap member of a sling assembly according to the present invention, includes an adjustable fastener 124 which may be, for example, a sliding cord fastener available from the Fastex Corporation of Des Plaines, Ill., and described in Bengtsson U.S. Pat. No. 3,564,670, the disclosure of which is hereby incorporated by reference. Preferably, the adjustable fastener 124 is attached to the sling strap member 16 by a loop of webbing 126 attached to the adjustable fastener 124 by a suitable fastener such as a rivet. Preferably, the loop 126 of webbing is slidably disposed about the front end portion 32 of the sling strap member 16. A front loop 128 shown used with the fastener 124 is a length of cord 134 such as the previously mentioned parachute cord which is held securely at a desired length by the action of the adjustable fastener 124. The ends of two parts 130 and 132 of the length of cord 134 are held together by a suitable fastener 136, which may, like the fastener 24, be a metal sleeve crimped about the ends of the parts 130 and 132. The fastener 136 is preferably coated with a suitable cushioning material such as a self-curing rubber or plastic composition, to prevent marring of the finish of the rifle 12.

An intermediate point 135 of the length of cord 134 is preferably fixedly attached, as by stitching, to a folded length of webbing material 137 to secure the cord 134 to a sling swivel 138. The length of cord 134 is long enough to permit the front end portion 32 of the sling strap member 16 to hang downwardly alongside the front end portion of the rifle 12 with either of the parts 130 and 132 of the length of cord 134 resting atop the barrel 14. The front end portion 32 is, accordingly, out of the way of the line of sight of the rifle 12 when it is being shot, when the cord 134 is extended from the fastener 124 as shown in FIG. 9.

Additionally, the fastener 124 facilitates use of the sling in the conventional military fashion. The sling swivel 138 is first detached from the eye 62, and the front loop 128 removed from about the front portion of the rifle 12. The cord 134 may then be drawn up snugly through the fastener 124, with the parts 130 and 132 holding the front end portion 32 of the sling strap member 16 close to the sling swivel 138. After the sling swivel 138 is reattached to the eye 62 the sling assembly can be used to carry the rifle 12 in the traditional manner with its barrel pointed upward behind the user's shoulder.

Figure 10:
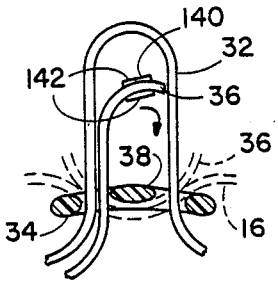
FIG. 10 is a sectional side view, taken along the line 10—10, of a portion f the front end of the sling strap member shown in FIG. 9.

As shown in FIGS. 9 and 10, instead of the terminal portion 36 being sewn to the front end portion 32 of the sling strap member 16 as shown in FIG. 2, a device such as a short rivet 140 having a pair of thin opposite heads may be attached to the terminal portion 36. Each head of the rivet 140 is preferably circular and has a diameter large enough to prevent the terminal portion 36 from being inadvertently pulled through the slide fastener 34 so long as the front end 32 of the sling strap member 16 extends snugly through the slide fastener 34, in contact with the central bar 38, as shown in FIG. 9. Nevertheless, the rivet 140 should be short enough, and its heads 142 thin enough so that the terminal portion 36 can be inserted through the fastener 34 when the front end portion 32 is loosely looped about the central bar 38 as shown in FIG. 10. Additionally, the presence of the rivet 140 provides a measure of resistance to the terminal portion 36 slipping from the three-bar slide fastener 34, should the front end portion 32 be inserted incorrectly through the fastener 34, as shown in broken line in FIG. 10. A preferred rivet 140 is commercially available as a tubular sheet steel back intended for attaching one part of a snap fastener to a fabric. Preferably, each head 142 has a ½ inch (12.5 mm) diameter and the rivet has a total length of about 3/32 inch (2.3 mm).

Figure 11:
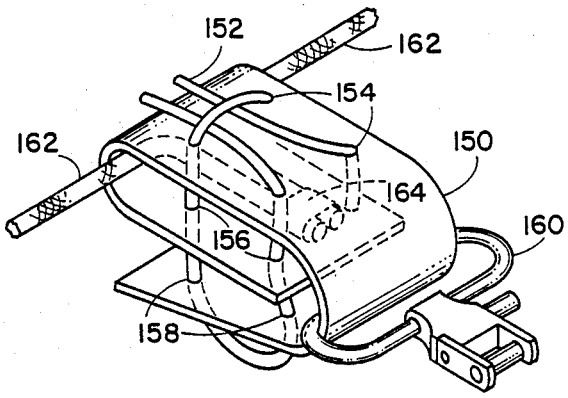
FIG. 11 is a perspective view of a leather strap and thong assembly attaching one of the cord loops of the sling assembly to a sling swivel.
Figure 12:
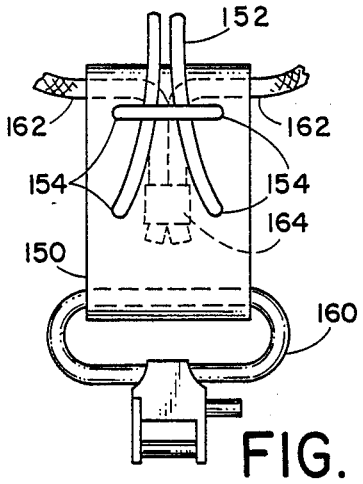
FIG. 12 is a top view of the leather assembly and sling swivel shown in FIG. 11.

FIGS. 11 and 12 show a short leather strap 150 used together with a thong 152 for engaging a sling swivel. The thong 152 is threaded through sets of corresponding holes 154, 156 and 158 located respectively in two opposite end portions and a middle portion of the leather strap 150. Although the thong 152 is shown in a loosened configuration for clarity, it will be appreciated that when the thong 152 is tightened it holds the strap 150 securely in a compact configuration with one end part extending through and holding the strap-receiving loop 160 of a sling swivel, while the other end extends through and holds a loop 162 of parachute cord whose ends are secured together by a fastener 164 similar to the fastener 24 discussed previously. The thong 152 extends as four separate parts between the holes 154 and 156, with two parts on each side of the ends of the cord where they are secured together by the fastener 164. The two parts of the cord of the loop 162 extend transversely outward in opposite directions from the leather strap 150 as in the previously described attachments of such loops to a sling swivel. This prevents the loop 162 from slipping laterally through the folded leather strap 150, so that this form of attachment of a loop to a sling swivel is useful either for a front loop 18 or a rear elongate connecting member 46 of the sling assembly 10 of the invention.

Figure 13:
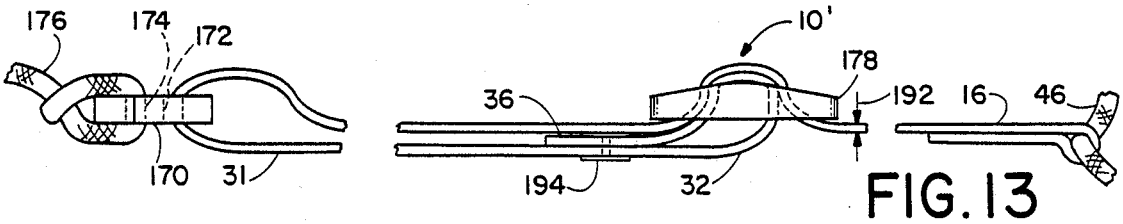
FIG. 13 is an edge view of another embodiment of the sling assembly of the present invention.
Figure 14:
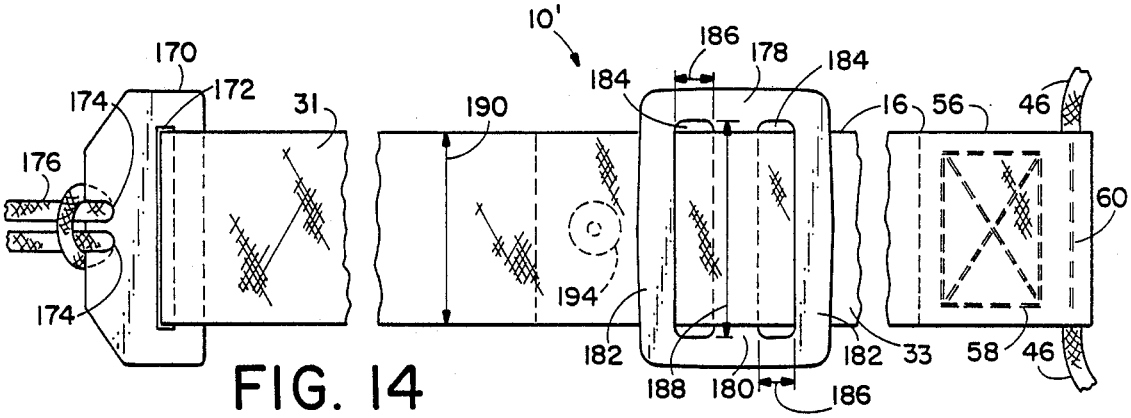
FIG. 14 is a top view of the sling assembly shown in FIG. 13.
Figure 15:
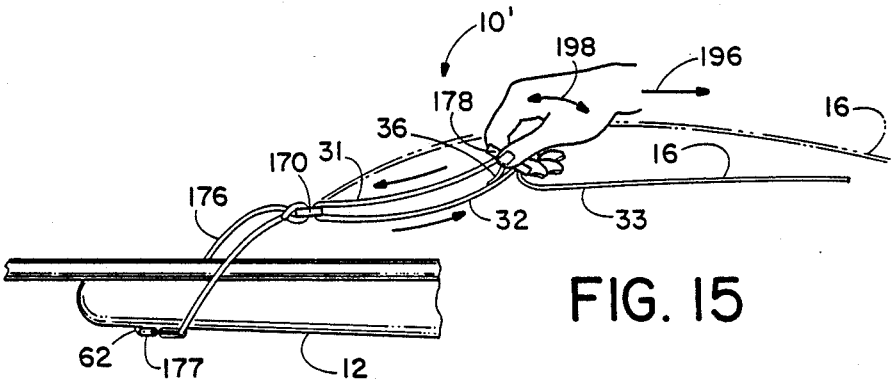
FIG. 15 is a view of a portion of a rifle equipped with the sling assembly shown in FIGS. 13 and 14.

Referring now to FIGS. 13–15, a sling assembly 10' which is yet another embodiment of the present invention includes a connector 170 which may be made from a moldable, tough, plastics material. The connector 170 includes a slot 172 though which the sling strap member 16 is engaged slidably. The slot 172 is large enough so that the sling strap 16 can easily slide through the slot 172. The connector 170 also defines a pair of holes 174 located side by side, preferably centered opposite the slot 172. A front loop 176 of parachute cord is fastened to the connector 170, extending through the holes 174 and tied to the connector 170 in a cowhitch knot. The two ends of the parachute cord defining the front loop 176 are attached to a sling swivel 177 (see FIG. 15), which is connected with a sling mounting eye 62 on the rifle 12.

A three-bar slide fastener 178 includes a central bar 180 and a pair of side bars 182 located on opposite sides of the central bar and spaced apart therefrom by a pair of slots 184 each having a width 186 and a length 188. Preferably, the length 188 of each of the slots is at least about ⅛ inch (3.2 mm) greater than the width 190 of the sling strap member 16, while the width 186 is at least about three times the thickness 192 (FIG. 13) of the sling strap member 16. The front end portion 32 of the sling strap member 16 is wrapped around the central bar 180 of the three-bar slide fastener 178 and the terminal portion 36 is fastened securely to the end portion 32 by a fastener such as a rivet 194 which may be similar to the rivet 140.

With the front end portion 32 of the sling strap member 16 securely fastened to the central bar 180 of the three-bar slide fastener 178, the sling assembly is easily adjustable, using only one hand to grasp the three-bar slide fastener 178 to slide it along the central portion 33 of the sling strap member 16 to adjust the effective overall length of the sling assembly 10 while it is attached to the rifle 12. Grasping the three-bar slide fastener 17B and moving it in the direction indicated by the arrow 196 of FIG. 15 pulls a portion of the sling strap member 16 through the slot 172 of the connector 170, increasing the amount of the sling strap member 16 which is doubled over around the connector 170 as a strap member adjustable loop 31 and reducing the overall effective length of the sling strap 16, from, for example, the configuration indicated by broken line in FIG. 15, to that shown in solid line. The effective length of the sling strap member 16 may be increased easily by grasping the three-bar slide fastener 178 and moving it in the opposite direction. Nevertheless, if the three-bar slide fastener 178 is of the proper size, it securely holds the sling strap member 16 at the desired effective length when the three-bar slide fastener 178 is not manually grasped.

One such three-bar slide fastener 178 which has been found to be effective in this application is manufactured by the Fastex Corporation of Des Plaines, Ill. Using such a three-bar slide fastener of a size the next larger than that normally intended for the width 190 of the sling strap member being used results in the ease of adjustability which is desired according to this invention. For example, use of a three-bar slide fastener 178 designed for use with webbing whose width is 1¼ inches is satisfactory when the sling strap member 16 is of webbing whose width 190 is 1 inch, since the greater length 188 and sufficient width 184 of the slots 184 of the larger three-bar slide 178 allow the webbing of the strap member 16 to slide easily through the slide fastener 178 when tension is relieved from the strap member 16 and the slide fastener 178 is held by the user.

FIG. 16 shows a preferred attachment device 200 for fastening a front loop 18 to the adjustable front strap loop 31 of a sling strap member 16. In the attachment device 200, a first length 202 of webbing, which may be the same type of webbing material used as the strap member 16, has its opposite ends overlying one another and pointing in the same direction, the central portion of the first length of webbing being folded around the cord of the front loop 18. The first length 202 is sewn to the ends of a second length 204 of similar webbing material approximately twice as long which is also doubled over on itself with its ends overlying and in contact with one another. The first length 202 of webbing material has its ends located on opposite sides of the overlying ends of the second piece of webbing material 204, and aligned perpendicular to them. The four layers of webbing material are all sewn tightly and securely together, as shown at 206 in FIG. 19, with the folded central portion of the first length 202 of webbing material defining a passageway 208 (FIG. 17), within which the front loop 18 is received. The loop of webbing material defined by the doubled second length 204 is thereafter turned inside out and placed about the outside of the joined overlapping end portions of the two lengths of webbing material, as indicated by the arrows 210 and 211 (FIG. 19), forming the two passageways 212 and 214, shown in FIG. 18. The adjustable front strap loop 31 is then mated with the attachment device 200 by passing an end of the strap member 16 through the passageway 212, thence around the bend in the first length of webbing material 202, and back in the opposite direction through the passageway 214. As a result the adjustable strap loop 31 remains adjustable, as it is slidable through the passageways 212 and 214.

The attachment device 200 keeps the webbing material of the adjustable front strap loop 31 securely attached to the front loop 18, while preventing the webbing of the strap member 16 from being stretched out of shape by tension in the two sides of the front loop 18. If it should be desired for the front loop 18 to be freely slidable within the attachment device 200, a tube (not shown) might be mounted within the passageway 208 defined by the first length of webbing material 202, but this is ordinarily not considered to be necessary, since the front loop 18 is ordinarily flexible enough and long enough so that the front end 32 of the strap member 16 will fall down to a position where it does not obstruct use of the sights of a weapon equipped with the sling assembly of the invention.

For a sling according to the present invention intended particularly for use with certain military rifles, such as the M-16 rifle, the rear elongate connecting member 46 may be attached to a sling receiving loop 216 mounted on the rifle butt stock 217 by the use of a stopper 218. The stopper 218 may be made of a suitable material such as moldable plastic, and includes an elongate base plate portion 220 large enough so that the stopper 218 cannot pass through the sling receiving loop 216. The base plate 220 defines a pair of holes 222 extending through the base plate 220 from top to bottom near each of the opposite ends of the base plate. Each of the holes 222 is large enough to permit passage of a single thickness of the parachute cord or other material of the rear elongate connecting member 46. A central hole 224 extends parallel with the holes 222 and is large enough to permit side-by-side passage of two parts of the cord or other material of the rear elongate connecting member 46.

A pair of locator prongs 226 are formed integrally with the base plate and extend therefrom through the sling loop 216 when the stopper 218 is in use. Preferably, the prongs 226 are resiliently flexible toward each other, and enlarged portions 228 extend outwardly from an upper end of each of the locator prongs 226, acting as detents to help retain the stopper 218 in position within the sling loop 216. Alternatively, the prongs 226 may diverge from each other by a small angle and not have the enlarged portions 228.

The stopper 218 is affixed to the rear elongate connecting member 46 with each end of the connecting member 46 extending downwardly through a respective one of the holes 222. The two ends of the connecting member 46 extend thence upwardly side-by-side through the central hole 224 and are fastened together adjacent the upper side of the base plate 220 by a fastener 230, similar to the fastener 24. The fastener 230 is too large to pass through the hole 224 and thus securely fastens the connecting member 46 to the stopper 218.

A pair of indentations 232 are provided on opposite sides of the base plate 220 to provide clearance for the stock 217 to permit the stopper 218 to be inserted fully and securely into a sling loop 216, even if installed in an upside-down orientation. The indentations 232 permit the stopper to be inserted far enough through the sling loop 216 so that the enlarged portions 228 will still be able to lock the stopper 218 into the sling loop 216 as if it had been properly inserted upwardly through the sling loop 216 as shown in FIG. 20.

A sling according to the present invention including this stopper 218 is normally attached to the military rifle with which it is to be used by passing the entire sling strap member 16 through the sling loop 216, thus pulling the entire rear elongate connecting member 46 upwardly through the sling loop 216 until the base plate 220 lodges against the sling loop 216 with the locator prongs 226 extending upwardly between the two parts of the rear elongate connecting member 46. The prongs 226 are flexible enough to pass upwardly through the sling loop 216, but thereafter the large portions 228 or the divergent ends of the prongs 226 resist removal of the stopper 218 from within the sling loop 216 under normal circumstances.

The rear elongate connecting member 46 can easily fall rearwardly over the butt end of the rifle stock 217, as indicated by the arrow 234, when the weapon is raised to the normal position for firing, so that it will not hinder quick and accurate shooting, while facilitating carriage of the weapon in the horizontal ready position.

Referring now to FIGS. 24–29, the front portion of a military rifle 240 is equipped with a handguard having an upper portion 242 and a lower portion 244 which surround the barrel 246 of the rifle, providing an air space to prevent the barrel 246 from becoming overheated and to prevent the rifleman's hands from being burned by the barrel 246 after extended shooting. The adjustable strap loop 31 of the front end of the sling strap member 16 is attached to the handguard by a front loop 248 attached to the lower portion 244 of the handguard by an attachment device 250. As may be seen best in FIGS. 25 and 27, the upper and lower portions 242 and 244 of the handguard each include a row of vent holes 252, whose primary purpose is to permit a flow of cooling air to reach the surface of the barrel 246.

As shown in FIGS. 28 and 29, the attachment device 250 includes a stud 254 of generally cylindrical shape extending upwardly away from a base plate 256, and a pair of semi-cylindrical stablizer portions 25B are located at opposite ends of the base plate 256, extending upwardly parallel with the stud 254 and spaced appropriately apart from the stud 254 so that the stud 254 and the stablizer portions 258 can simultaneously fit within consecutive ones of the vent holes 252. Thus installed, the attachment device 250 is prevented from rotating relative to the length of the lower portion 244 of the handguard.

The front loop 248, of parachute cord or other appropriate material, extends through a tube 260 defined in the body 250 and located beneath the base plate 256. The tube 260 extends parallel with the length of the base 256, so that a quarter twist is provided in the loop 248 when the stud 254 and stablizers 258 are located within respective ones of the vent holes 252 as shown in FIG. 29.

Figure 26:
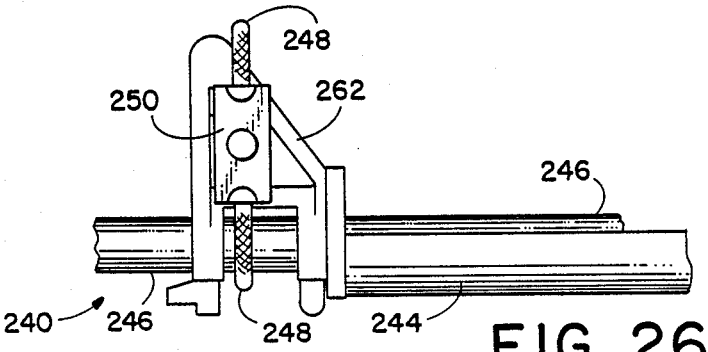
FIG. 26 is a side view of a portion of a shoulder weapon similar to that shown in FIG. 24, with a portion of the handguard thereof removed, showing the manner of placing the front loop portion of the sling assembly on the weapon.

This quarter twist is important, as may be appreciated with reference to FIG. 26, showing the rifle 240 with the upper portion 242 of the handguard removed therefrom. The loop 248 is of barely sufficient length to permit the front loop to pass over the front sight assembly 262 of the weapon with the length 263 of the base 250 aligned with the flexible cord or similar material of the front loop 248. Once the front loop 248 has passed rearwardly over the front sight assembly 262, the attachment device 250 is attached to the upper or lower portion 242 or 244 of the handguard by engaging the stud 254 and stabilizers 258 in appropriate vent holes 252.

Figure 27:
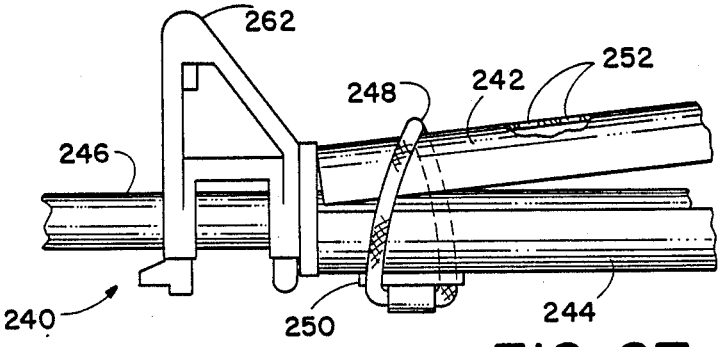
FIG. 27 is a side view of a portion of a shoulder weapon similar to that shown in FIG. 24, showing the upper portion of the handguard being replaced on the weapon, with the front loop attachment device shown in FIGS. 24–26 engaged in the bottom portion of the handguard of the weapon.

The length of the front loop 248 is chosen so that there is then barely room for the upper portion 242 of the handguard to be replaced in its normal position, as shown in FIG. 27. The height of the stud 254 and stablizer portions 258 is sufficient to prevent their disengagement from the vent holes 252 when the upper portion 242 has been replaced, while the quarter twist provided by the orientation of the tube 260 gives sufficient additional length to the front loop 248 to permit it to pass over the front sight assembly 262 and still be snug enough to prevent the attachment device 250 from being disengaged from the vent holes 252.

Nevertheless, sufficient clearance remains between the front loop 248 and the upper portion 242 of the handguard for the strap adjustable loop 31 to be inserted within the front loop 248 to attach the sling strap member 16 to the front portion of the rifle 240. The front loop attachment device 250 shown in FIGS. 24–29 may be manufactured, for example, of a moldable plastic material having suitable heat resistance. The front loop 248 is of material whose opposite ends are connected to one another in direct opposition by a sleeve 264 appropriately crimped to securely fasten the ends to one another. The sleeve 264 is preferably located within the tube 260.

Referring to FIG. 30, a front loop attachment device 270 is similar to the front loop attachment device 250, except that it includes a transversely oriented tube 272 through which the front loop 248 extends. Because installation of the attachment device 270 does not provide a quarter twist in the front loop 248 as does installation of the attachment device 250, the tube 272 is separated by a greater distance beneath the base of the stud 254 and stablizer members 258 than is the tube 260 in the attachment device 250, in order for the front loop 248 to be long enough to pass over the front sight assembly 262, yet have the front loop attachment device 270 be securely held in the vent holes 252 of the lower portion 244 of the handguard.

Another front loop attachment device 276 is shown in FIGS. 31 and 32 and includes a sheet metal base plate 278, and a spacer body 280 to provide the required shortening of the front loop 282, yet permit the front loop 282 to be long enough to pass over the front sight assembly 262. The spacer body 280 may be of, for example, a suitable plastics material which is heat resistant enough not to melt when exposed to the temperatures generated by continued rapid firing of such a rifle. Stablizer tabs 284 are upwardly bent extensions of the base plate 278, and a stud 286 is riveted or otherwise equivalently attached to the base plate 278, also attaching the spacer body 280 to the base plate 278. The front loop 282 associated with the attachment device 276 has its opposite ends located side-by-side and parallel with one another, attached to the base plate 278 by a pair of crimped ears 288 which are also formed integrally with the sheet metal base plate 278.

Figure 33:
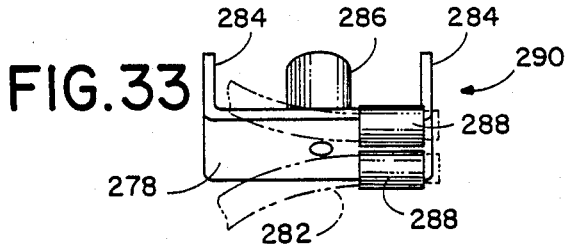
FIG. 33 is a perspective view, taken from below and to one side, of a fourth front loop attachment device for attaching the front end of a sling strap loop to the handguard of a military weapon such as that shown in FIG. 24.

FIG. 33 shows a front loop attachment device 290 which is similar to the front loop attachment device 276, except for the lack of a spacer body, and the stablizer tabs 284 are accordingly shorter.

Figure 24:
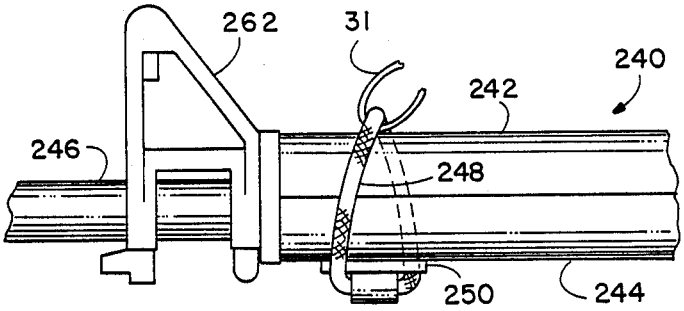
FIG. 24 is a side view of a front portion of a shoulder weapon in a horizontal upright attitude, showing the front portion of the sling assembly of the present invention and a front loop attachment device according to the invention for attaching a front end of the sling strap member to a handguard portion of the shoulder weapon.
Figure 25:
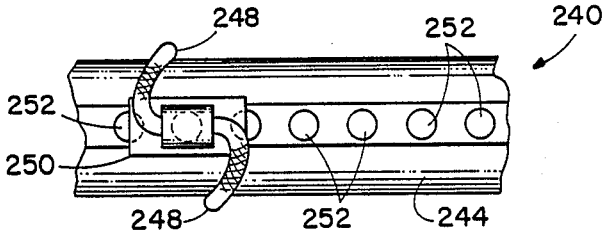
FIG. 25 is a bottom view of a portion of the shoulder weapon shown in FIG. 24, showing the front loop attachment device for attaching the front end of the sling strap member to the handguard of the weapon as in FIG. 24.
Figure 34:
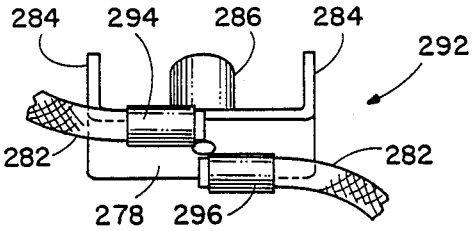
FIG. 34 is a perspective view similar to that shown in FIG. 33,, of a fifth front loop attachment device which is a variation of that shown in FIG. 33.

FIG. 34 shows a similar front loop attachment device 292 in which the crimped clamping ears 294 and 296 holding the front loop 282 are separated longitudinally and extend from opposite sides of the base plate 278 in order to provide a quarter twist in the front loop 282 when the front loop attachment device 292 is engaged in the vent holes 252 of the rifle 240 in the same manner in which the front loop attachment device 250 is shown in FIGS. 24 and 25.

Figure 35:
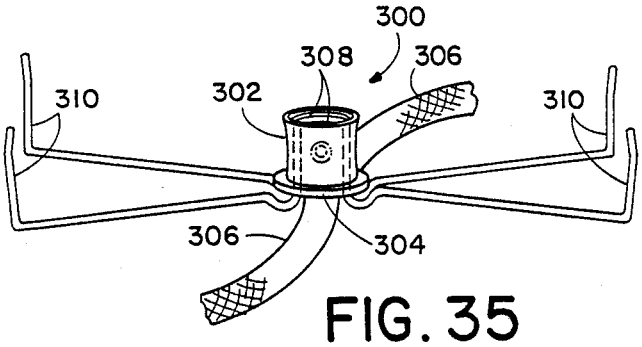
FIG. 35 is a perspective view, taken from one side, of a sixth front loop attachment device according to the present invention for use in attaching a front strap loop of a sling assembly to a military weapon such as that shown in FIG. 24.
Figure 36:
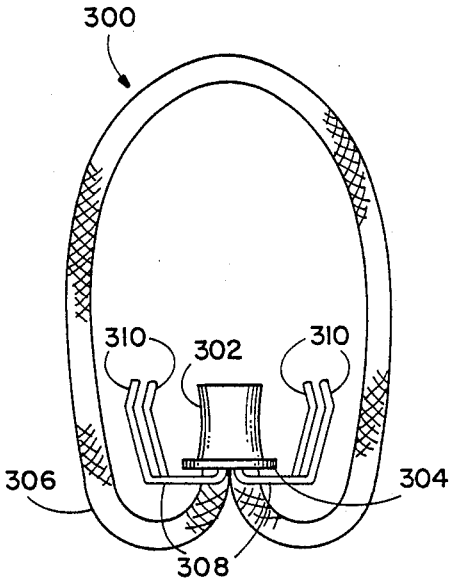
FIG. 36 is a perspective view, taken from one end, of the device shown in FIG. 35.

The front loop attachment device 300 shown in FIGS. 35 and 36 includes a tubular stud 302 having a flange 304 to limit the distance to which the stud 302 can be extended into a vent hole 252. The opposite ends of a piece of flexible material making up a front loop 306 are clamped within the stud 302, along with a pair of wires 308 which extend in both directions away from the stud 302 and include upwardly and outwardly directed outer ends 310 located so as to fit within ones of the vent holes 252 located, respectively, on either side of the vent hole 252 within which the stud 302 is located. The outer ends 310 are separated from one another in a relaxed state, so that they can be removed from their respective vent holes 252 only by overcoming their natural resilient biasing force, and they thus retain the stud 302 engaged in its respective one of the vent holes 252. For this reason, the front loop 306 may be made long enough to easily pass over any front sight assembly present on a weapon with which the front loop attachment device 300 is to be used.

Another front loop attachment device 312, shown in FIGS. 37 and 38, includes a base plate 314 and a pair of hollow studs 316 attached thereto, for example by riveting, both the base plate 314 and the studs 316 preferably being of metal. A front loop 318 has a stopper collar 320 fastened on each of the two ends of the flexible material forming the loop. The front loop 318 is preferably of metal cable and has a coating of resilient material as protection against becoming frayed and thereby damaging a nylon string strap member 16 used in association with it. The length of the front loop 318 is chosen so as to be snug enough to retain the front loop attachment device 312 attached to the handguard of the rifle 240 when both the upper portion 242 and lower portion 244 are in place, with each of the studs 316 engaged in a respective one of a pair of adjacent ones of the vent holes 252. Attachment of the opposite ends of the front loop 318 to the two studs 316 provides the quarter twist shortening effect previously described, in order to provide ample length of the front loop 318 to permit it to be passed over the front sight assembly of a weapon such as the rifle 240. The use of the stoppers 320 together with the hollow studs 316 permits the front loop 318, if made of metal cable, to swivel as necessary to avoid kinking the cable material.

A front loop attachment device 322, shown in FIG. 39, includes a single stud 324 which may be essentially similar to the stud 302, shown in FIGS. 35 and 36, or which may have a closed upper end. It includes a flange 326 to limit its extension into a vent hole 252, and the associated front loop 328 must be of the appropriate length to retain the stud 324 within the vent hole 252 as explained previously in connection with others of the front loop attachment devices disclosed herein.

Figure 40:
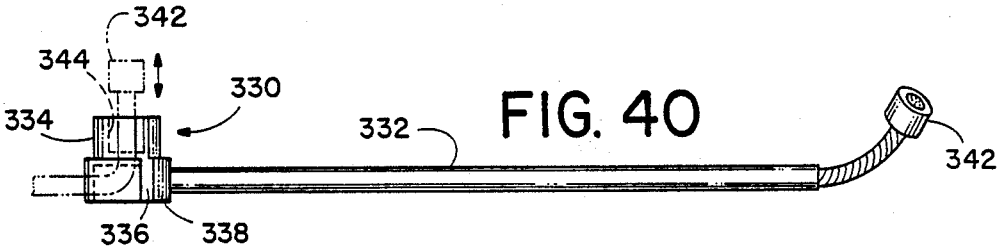
FIG. 40 is a view of a ninth front loop attachment device useful for attaching a front sling strap member to the handguard of a military rifle such as that shown in FIG. 24, in which an end of the loop is detachable from a plug portion of the device.
Figure 41:
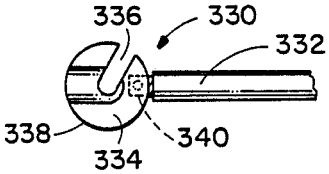
FIG. 41 is a bottom view of the plug portion of the device shown in FIG. 40.
Figure 42:
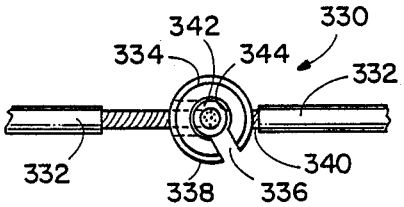
FIG. 42 is a top view of the plug portion of the device shown in FIG. 40, with both ends of the loop attached to the plug portion thereof.

A front loop attachment device 330, shown in FIGS. 40–42, is associated with a front loop 332, which is preferably of metal cable with a sheath of resilient, tough material to protect the metal from being frayed. The attachment device 330 includes a slotted machined or molded metal stud 334 including a slot 336 and a base flange 338 into which one end of the front loop 332 is fastened as at 340. The end of the front loop 332 may be attached, for example, by mechanically crimping a portion of the base flange 338 to grip the end of the front loop 332 within a hold defined in the flange 338. A stopper collar 342 is appropriately secured to the opposite end of the front loop 332 and is received within a cavity 344 defined within the stud 334 and communicating with the slot 336 to close the loop 332 as indicated in FIGS. 40 and 42. The length of the loop 332 must be chosen to fit around the handguard of the weapon and retain the stud 334 in one of the vent holes 252 as explained in connection with previously described front loop attachment devices.

Figure 43:
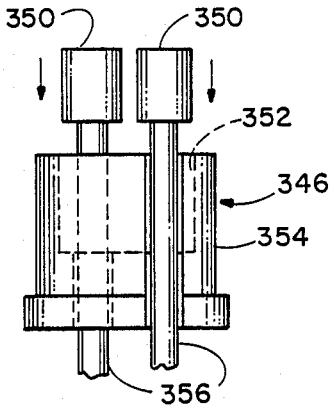
FIG. 43 is a view of a plug portion and the two ends of the loop of yet a tenth device for attaching the front portion of the strap member of a sling assembly to the handguard of a shoulder weapon such as that shown in FIG. 24.
Figure 44:
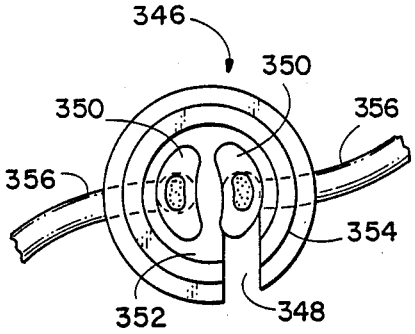
FIG. 44 is a top view of the plug and the ends of the loop of the device shown in FIG. 43.

In FIGS. 43 and 44 a similar front loop attachment device 346 includes a slot 348, and stopper collars 350 on the opposite ends of the front loop 356 interfere with each other to retain the stoppers 350 within a cavity 352 defined within the stud portion 354, holding together the ends of the front loop 356.

Figure 45:
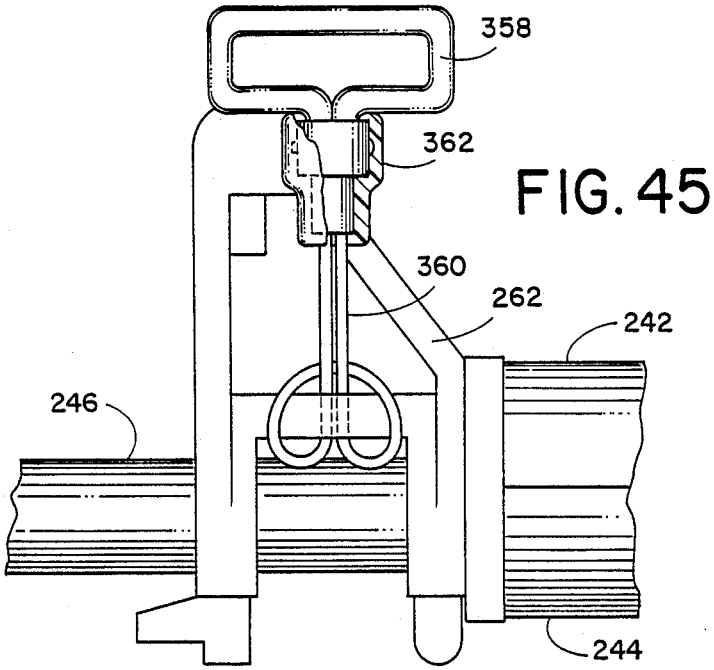
FIG. 45 is a perspective view of a device for attaching the strap receiving loop to the front sight assembly of a shoulder weapon in order to attach the front portion of a sling strap member to the front portion of such a shoulder weapon.

Yet a further alternative device for attaching the adjustable front loop 31 of the sling strap member 16 to the forward portion of a rifle is the sling receiving loop 358 shown in FIG. 45. Resembling the sling receiving loop of a conventional sling swivel, it is attached to an attachment loop 360 of flexible material such as a metal cable, preferably coated with a resilient covering material. Additionally, a resilient sheath 362, shown partially cut away in FIG. 45, is preferably provided to prevent undesired noise which might otherwise be caused by the device striking against another part of a weapon with which it is used. The attachment loop 360 is preferably about six inches in circumference, providing sufficient length for it to be looped around a portion of a front sight assembly 262, as shown, with sufficient room remaining for the sling attachment loop 358 to be passed through the attachment loop 360.

Figure 46:
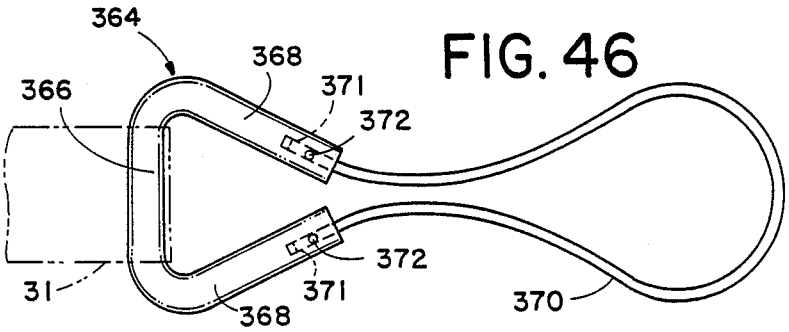
FIG. 46 is a view of another device similar to that shown in FIG. 45.

A similar device is the sling strap securing device 364, shown in FIG. 46, in which a piece of small metal bar stock is bent to provide a sling strap receiving loop having a crossbar 366 and a pair of legs 368, with one end of a loop 370 of flexible cable, similar to the loop 360, being attached to the end of each leg 368, as by being received in bores 371, with the legs 368 being crimped or punched as at 372.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. In combination with a shoulder weapon of the type having a front portion and a butt stock located rearwardly from said front portion, said butt stock having a butt end, a bottom, a pair of sides, and a rear sling receiving loop attached to said botton, a sling assembly comprising:

(a) a rear end portion extending through said rear sling receiving loop and arranged so as to attach said sling assembly to said butt stock;

(b) a rear elongate connecting member connected fixedly to said rear end portion, said rear elongate connecting member including a pair of generally parallel parts of substantially equal length, said butt stock being located between said pair of parts and said pair of parts being rearwardly removable from their location adjacent said butt stock;

(c) a sling strap member having a front end and having a rear end fixedly connected to said rear elongate connecting member;

(d) a front end portion of said sling assembly being attached to a front portion of said shoulder weapon, and (e) means associated with said sling strap member for connecting said front end of said sling strap member to said front end portion of said sling assembly.

2. A sling assembly for carrying a shoulder weapon of the type having a front portion and a butt stock located rearwardly from said front portion, said butt stock having a butt end, a bottom, and a pair of opposite sides, the sling assembly comprising:

(a) a sling strap member having a front end and a rear end;

(b) a rear elongate connecting member connected fixedly to said rear end of said sling strap member, said rear elongate connecting member including a pair of parallel parts of flexible material of substantially equal length extending away from said rear end of said sling strap member;

(c) rear end attachment means connected with said rear elongate connecting member, for attaching said rear elongate connecting member to said bottom of said butt stock with one of said pair of parallel parts extending on each of said opposite sides of said butt stock, said rear end attachment means including stopper means, attached to said rear elongate connecting member and spaced apart from said rear end of said sling strap member by said pair of parallel parts, for attaching said rear elongate connecting member to a strap-receiving loop associated with said bottom of said butt stock of said shoulder weapon; and (d) means for connecting said front end of said sling strap member to said front portion of said shoulder weapon.

3. The sling assembly of claim 2, said means for connecting said front end of said sling strap member including a front loop of elongate flexible material connected to said front end of said sling strap member, said front loop having front end attachment means connected thereto for attaching said front loop to said front portion of said shoulder weapon.

4. The sling assembly of claim 2 wherein said stopper means includes a stopper having an elongate base plate, said base plate having an upper side, and said stopper further including a pair of prongs extending upwardly from said upper side and spaced apart from each other longitudinally of said base plate, and said base plate further defining hole means for receiving said pair of parts of said rear elongate connecting member and for fastening the ones of said pair of parts to said base plate.

5. The sling assembly of claim 4 wherein said hole means includes a pair of smaller holes defined by said base plate, a respective one of said smaller holes being located proximate each end of said base plate and extending through said base plate generally parallel with said prongs, and a larger hole defined by said base plate and extending through said base plate between and generally parallel with said prongs, said larger hole being large enough for both parts of said rear elongate connecting member to pass therethrough and each of said smaller holes being large enough for one of said pair of parts of said rear elongate connecting member to pass therethrough, and wherein one of said pair of parts of said rear elongate connecting member extends through each of said smaller holes and both of said pair of parts extend through said larger hole and are fastened together between said prongs adjacent said upper side of said base plate by a fastener too large to pass through said larger hole.

6. The sling assembly of claim 2, said means for connecting said front end of said sling strap member to said front portion of said shoulder weapon including a sling strap-receiving loop of rigid material, connected to said front end of said sling strap member, and a loop of elongate flexible material fixedly connected to said sling strap-receiving loop.

7. The sling assembly of claim 6 wherein said sling strap receiving loop is of metal and has a pair of open ends, said loop of elongate flexible material being secured thereto with portions thereof extending into said open ends, portions of said metal being deformed to secure said elongate flexible material mechanically.

8. The sling assembly of claim 7 wherein said loop of elongate flexible material is at least six inches in circumference.

9. A sling assembly for carrying a shoulder weapon of the type having a front portion and a butt stock located rearwardly from said portion, comprising:

(a) a sling strap member having a front end and a rear end;

(b) rear end attachment means connected with said rear end of said sling strap member for attaching said rear end to the butt stock of said shoulder weapon; and (c) front end attachment means for connecting said sling assembly to said front portion of said shoulder weapon, said front end attachment means including a sling strap-receiving loop of rigid metal material, connected to said front end of said sling strap member and having a pair of open ends, and a loop of elongate flexible material fixedly connected to said sling strap-receiving loop with portions of said elongate flexible material extending into said open ends, portions of said metal material being deformed to secure said elongate flexible material mechanically within said open ends.

10. The sling assembly of claim 9 wherein said loop of elongate flexible material is at least six inches in circumference.

11. In combination with a shoulder weapon of the type having a front portion and a butt stock located rearwardly from said front portion, said butt stock having a butt end, a bottom, and a pair of sides, a sling assembly comprising:

(a) a sling strap member having a front end and a rear end;

(b) a rear elongate connecting member connected to said rear end of said sling strap member and including a pair of parallel parts of flexible material of substantially equal length extending away from said rear end of said sling strap member;

(c) rear end attachment means connected with said rear elongate connecting member for attaching said rear elongate connecting member to said butt stock; and (d) a front loop of flexible material attached to said front end of said sling strap member and extending loosely around said front portion of said shoulder weapon, said front loop having front end attachment means connected therewith for fastening said front loop to said front portion of said shoulder weapon.

12. A sling assembly for carrying a shoulder weapon of the type having a front portion and a butt stock located rearwardly from said front portion, said butt stock having a butt end, a bottom, and a pair of opposite sides, the sling assembly comprising:

(a) a front sling swivel having a sling-receiving loop;

(b) a rear sling swivel having a sling-receiving loop;

(c) a sling strap member having a front end and a rear end;

(d) a rear elongate connecting member connected to said elongate connecting member including a pair of rear end of said sling strap member, said rear flexible parallel parts of substantially equal length extending away from said sling strap member;

(e) rear end stopper means, connected to said rear elongate connecting member, for engaging said sling-receiving loop of said rear sling swivel with said rear elongate connecting member extending through said sling-receiving loop of said rear sling swivel;

(f) a front loop of elongate flexible material separate from, but connected to, said front end of said sling strap member; and (g) front end attachment means for attaching said front loop of elongate flexible material to said sling-receiving loop of said front sling swivel.

13. The sling assembly of claim 12 wherein said front loop of elongate flexible material is connected to said front end of said sling strap member with said front loop extending transversely with respect to said sling strap member.

14. A sling strap securing device for attaching a sling strap member of a sling assembly to a front portion of a shoulder weapon, the sling strap securing device comprising:

(a) a sling strap-receiving loop of rigid material including a cross bar and a pair of legs extending convergently toward one another from opposite ends of said cross bar, each of said legs having an open end; and (b) a loop of elongate flexible material, said loop having a predetermined circumference, respective portions of said flexible material extending into said open ends and being secured thereto by portions of said metal being deformed to grip said portions of said elongate flexible material mechanically.

15. The sling strap securing device of claim 14 wherein said predetermined circumference is at least six inches.

* * * * *

UNITED STATES PATENT AND TRADEMARK OFFICE

CERTIFICATE OF CORRECTION

PATENT NO. : 4,823,998

DATED : April 25, 1989

INVENTOR(S) : David A. Johnson

It is certified that error appears in the above-identified patent and that said Letters Patent is hereby corrected as shown below:

| | | |
|---|---|---|
| Col. 4, | Line 30 | Change "f" to --of--. |
| Col. 5, | Line 40 | After "33," delete --,--. |
| Col. 7, | Line 59 | Change "i" to --is--. |
| Col. 11, | Line 9 | Change "17B" to --178--. |
| Col. 13, | Line 41 | Change "25B" to --258--. |
| Col. 17, | Line 6 | Change "weapon," to --weapon;--. |

Signed and Sealed this

Thirtieth Day of July, 1991

*Attest:*

*Attesting Officer*

HARRY F. MANBECK, JR.

*Commissioner of Patents and Trademarks*